US006622896B2

(12) United States Patent
Hegeman et al.

(10) Patent No.: US 6,622,896 B2
(45) Date of Patent: Sep. 23, 2003

(54) DISHWASHER DETERGENT DISPENSER

(75) Inventors: Arjan Johannes Hegeman, Louisville, KY (US); Jeffrey Thomas Kiesler, Louisville, KY (US); Gregory Alan Meyer, Taylorsville, KY (US); Gregory Owen Miller, Louisville, KY (US); Christopher Raymond Geisen, Louisville, KY (US); Glenn Leon Graham, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,861

(22) Filed: Oct. 25, 2001

(65) Prior Publication Data

US 2003/0080162 A1 May 1, 2003

(51) Int. Cl.[7] ..... A47L 15/46; D06F 39/02

(52) U.S. Cl. ..... 222/651; 134/57 D; 134/58 D

(58) Field of Search ..... 222/556, 651, 222/652; 134/56 D, 57 D, 58 D, 93

(56) References Cited

U.S. PATENT DOCUMENTS

| | | | | | |
|---|---|---|---|---|---|
| 2,946,489 | A | * | 7/1960 | Brucken | 222/651 |
| 3,402,853 | A | * | 9/1968 | Perl | 222/651 |
| 3,827,600 | A | * | 8/1974 | Janke | 222/70 |
| 4,790,981 | A | | 12/1988 | Mayer et al. | |
| 5,033,659 | A | * | 7/1991 | Marks et al. | 222/651 |
| 5,133,487 | A | * | 7/1992 | Russi | 222/651 |
| 5,310,090 | A | | 5/1994 | Taylor, Jr. | |
| 6,244,277 | B1 | | 6/2001 | Maunsell | |

* cited by examiner

*Primary Examiner*—Joseph A. Kaufman
(74) *Attorney, Agent, or Firm*—George L. Rideout, Jr.; Armstrong Teasdale, LLP

(57) ABSTRACT

A dispenser is provided which includes a body including a trough, and a cover attached to the body and including a flow path extending into the trough.

19 Claims, 3 Drawing Sheets

DISHWASHER DETERGENT DISPENSER

BACKGROUND OF THE INVENTION

This invention relates generally to detergent dispensers, and more particularly, to detergent dispensers for dishwashers.

Known dishwasher systems include a cabinet, a tub within the cabinet that defines an open sided wash chamber, and a door assembly that seals the open side of the wash chamber when the dishwasher is in use. Soiled dishes, glasses, utensils, food and beverage containers, etc. are loaded into the dishwasher tub through the open side of the wash chamber when the door is open, and after the door is closed, a dishwasher cycle may be executed to clean the items placed therein. The wash chamber includes a sump portion where washing fluid is pumped from a fluid circulation assembly through spray arm conduits to wash items loaded onto dishwasher racks in the wash chamber, and also where wash fluid is collected after being circulated throughout the wash chamber. The door assembly is attached to the dishwasher at a bottom end of the door and pivots about a hinge between fully open and fully closed positions.

Some type of dishwashers include a detergent dispenser attached to the inner portion of the door assembly. The detergent dispenser includes a trough and a hinged lid or cover that closes the trough and prevents solid or powdered detergent therein from moisture until a designated time in a wash cycle. At the proper time, the cover is opened and the detergent in the trough is released. However, to remove all of the detergent from the dispenser, or to more quickly release detergent from the dispenser, a water spray jet is typically directed into the trough to clear detergent from the dispenser trough.

However, the detergent dispenser cover can sometimes interfere with the water jet when the cover is incompletely opened, thereby preventing timely release of detergent from the trough. In addition, it can be challenging to properly direct a water jet to clear the detergent trough, and even when appropriately directed, the trough clearing water jet impact portions of the dishwasher door assembly and generates undesirable noise during operation of the dishwasher.

SUMMARY OF THE INVENTION

In one aspect, a dispenser is provided which comprises a body comprising a trough, and a cover attached to said body and comprising a flow path extending into said trough.

In another aspect, a detergent dispenser is provided that comprises a body comprising a trough, and a cover pivotally attached to said cover at one end. The cover comprises an inner surface and a baffle extending therefrom toward said trough.

In a further aspect, a detergent dispenser for a dishwasher door assembly, said dispenser comprising a body comprising a trough, and a cover comprising a first end, a second end, and an inner surface extending between said ends. The cover is selectively positionable between a closed position and an open position. The cover comprises a flow path in fluid communication with said trough when said cover is in said open position, and the flow path obstructed when said cover is in said closed position.

In still another aspect, a dishwasher is provided that comprises a wash chamber, and a detergent dispenser in flow communication with said wash chamber. The detergent dispenser comprises a body comprising a trough, and a cover comprising an inner surface and a baffle extending from said inner surface. The cover is attached to said body and is selectively positionable between a closed position and an open position, and the baffle defines a flow path into said trough when said cover is in said open position.

DETAILED DESCRIPTION

Figure 1:
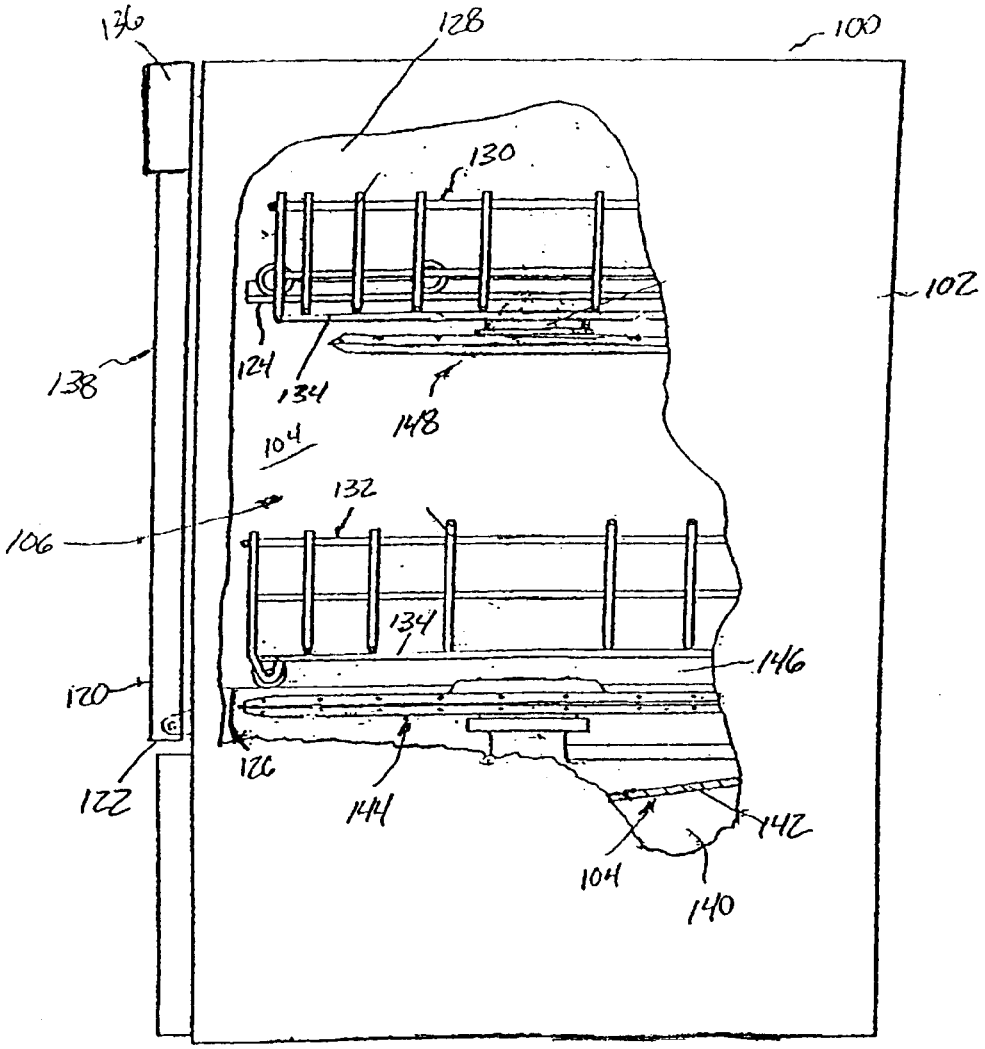
FIG. 1 is a side elevational view of an exemplary dishwasher system partially broken away.

FIG. 1 is a side elevational view of an exemplary domestic dishwasher system 100 partially broken away, and in which the present invention may be practiced. It is contemplated, however, that the invention may be practiced in other types of dishwashers and dishwasher systems beyond dishwasher system 100 described and illustrated herein. Moreover, the dispenser of the present invention may find utility in other applications wherein dispensers in wet environments are desirable. Accordingly, the following description is for illustrative purposes only, and the invention is in no way limited to use in a particular application, or to a particular type of appliance, such as, for example dishwasher system 100.

Dishwasher 100 includes a cabinet 102 having a tub 104 therein and forming a wash chamber 106. Tub 104 includes a front opening (not shown in FIG. 1) and a door assembly 120 hinged at its bottom 122 for movement between a normally closed vertical position (shown in FIG. 1) wherein wash chamber 106 is sealed shut for washing operation, and a horizontal open position (not shown) for loading and unloading of dishwasher contents. Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control panel (not shown in FIG. 1) is integrated into an escutcheon 136 that is mounted to door assembly 120, or in further and/or alternative embodiments control selectors, (e.g., buttons, switches or knobs) or control displays, etc. may be mounted at a convenient location on an outer face 138 of door assembly 120. The control panel and associated selectors and displays are coupled to known control circuitry (not shown) and control mechanisms (not shown) for operating a fluid circulation assembly (not shown) that circulates water and dishwasher fluid in dishwasher tub 104. The fluid circulation assembly is located in a machinery compartment 140 located below a bottom sump portion 142 of tub 104. The construction and operation of the fluid circulation assembly is believed to be beyond the scope of the present invention but well within the purview of those in the art without detailed explanation, and further discussion of the fluid circulation assembly is therefore omitted.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 and is located in close proximity to upper rack 130 and at a sufficient height above lower rack 132 to accommodate a largest item, such as a dish or platter (not shown), that is expected to be placed in lower rack 132 and washed in dishwasher system 100. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 provides a rotational force by virtue of washing fluid flowing through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated and door assembly 120 is properly closed to seal wash chamber 106 for operation.

Figure 2:
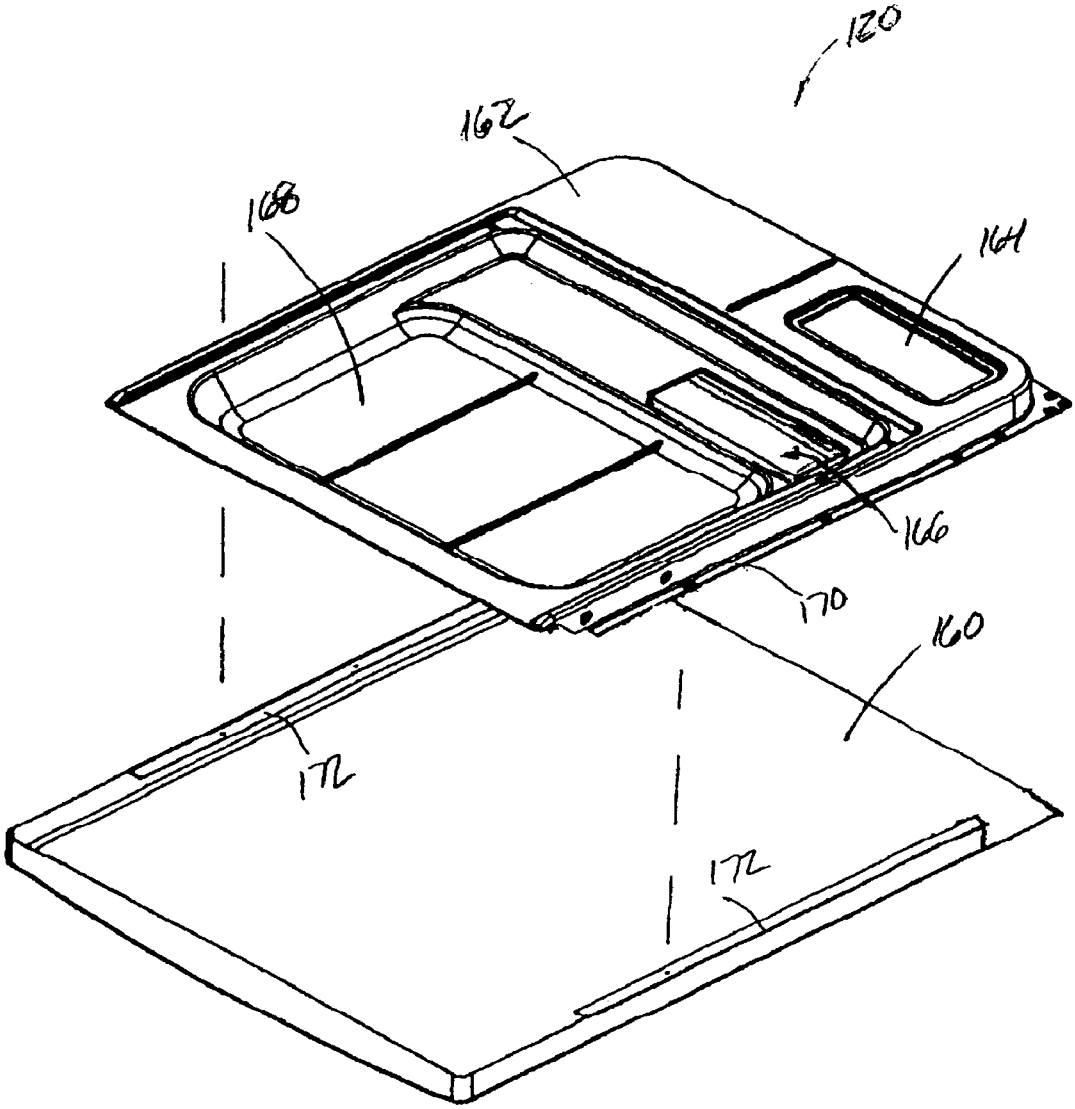
FIG. 2 is a perspective exploded view of a dishwasher door assembly including a detergent dispenser for the dishwasher shown in FIG. 1.

FIG. 2 is an exploded perspective view of an exemplary dishwasher door assembly 120 that may be used, for example, with dishwasher 100 (shown in FIG. 1). Door assembly 120 includes an outer door panel 160 and an inner door panel 162.

Inner door panel 162, in an exemplary embodiment, includes an opening 164 therethrough for a vent assembly (not shown) and an opening (not shown in FIG. 2) for receiving a detergent dispenser 166. Inner door panel 162 is further contoured in a bottom region 168 for accommodating lower rack 132 (shown in FIG. 1) of dishwasher 100 (shown in FIG. 1). In an illustrative embodiment, inner door panel 162 is attached to outer door panel 160 via attachment flanges 170 on an outer perimeter of inner door panel 162 that are fastened to attachment flanges 172 in outer door panel 160. In one embodiment, an appliance control module (not shown) and a latch assembly (not shown) are further accommodated into door assembly 120 as those in the art will appreciate.

In use, dispenser 166 is filled with known dishwasher detergent, such as commercially available powder dishwasher detergent products, and when dishwasher racks 130, 132 are loaded with items to be washed, door assembly 120 is closed, thereby sealing wash chamber 106 for operation of wash cycles. At an appropriate time in a wash cycle, dispenser 166 is opened to release its detergent contents into dishwasher wash chamber 106 (shown in FIG. 1) wherein the detergent is mixed with water to produce a cleansing fluid for circulation throughout wash chamber 106.

It is noted that exemplary inner door panel 162 and outer door panel 160 are intended for illustrative purposes only, and that the present invention may be used with differently configured inner and/or outer door panels within the scope of the present invention. It is further contemplated that detergent dispenser 166, as explained further below, may located elsewhere relative to wash chamber 106 (shown in FIG. 1) of dishwasher system 100 (shown in FIG. 1) than in door assembly 122 without departing from the scope of the present invention. In other words, detergent dispenser 166 need not be attached to door assembly 120 and could be positioned elsewhere to accomplish at least some of the benefits of the present invention.

Figure 3:
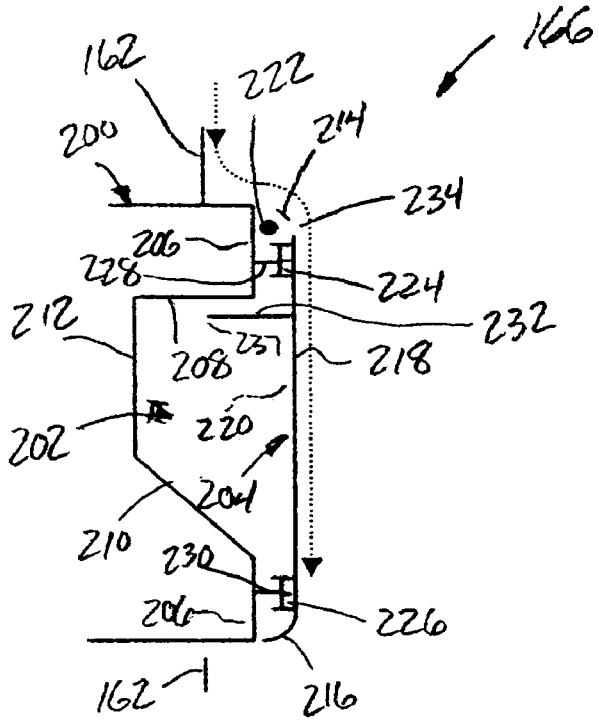
FIG. 3 is a cross-sectional schematic illustration of the dispenser shown in FIG. 2 in a closed position.
Figure 4:
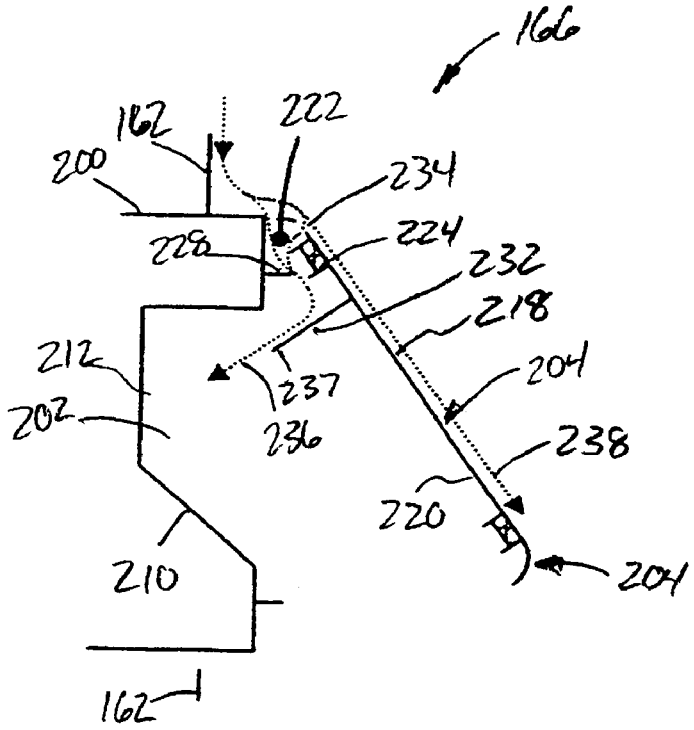
FIG. 4 is a cross sectional schematic illustration of the dispenser shown in FIG. 2 in an open position.
Figure 1:
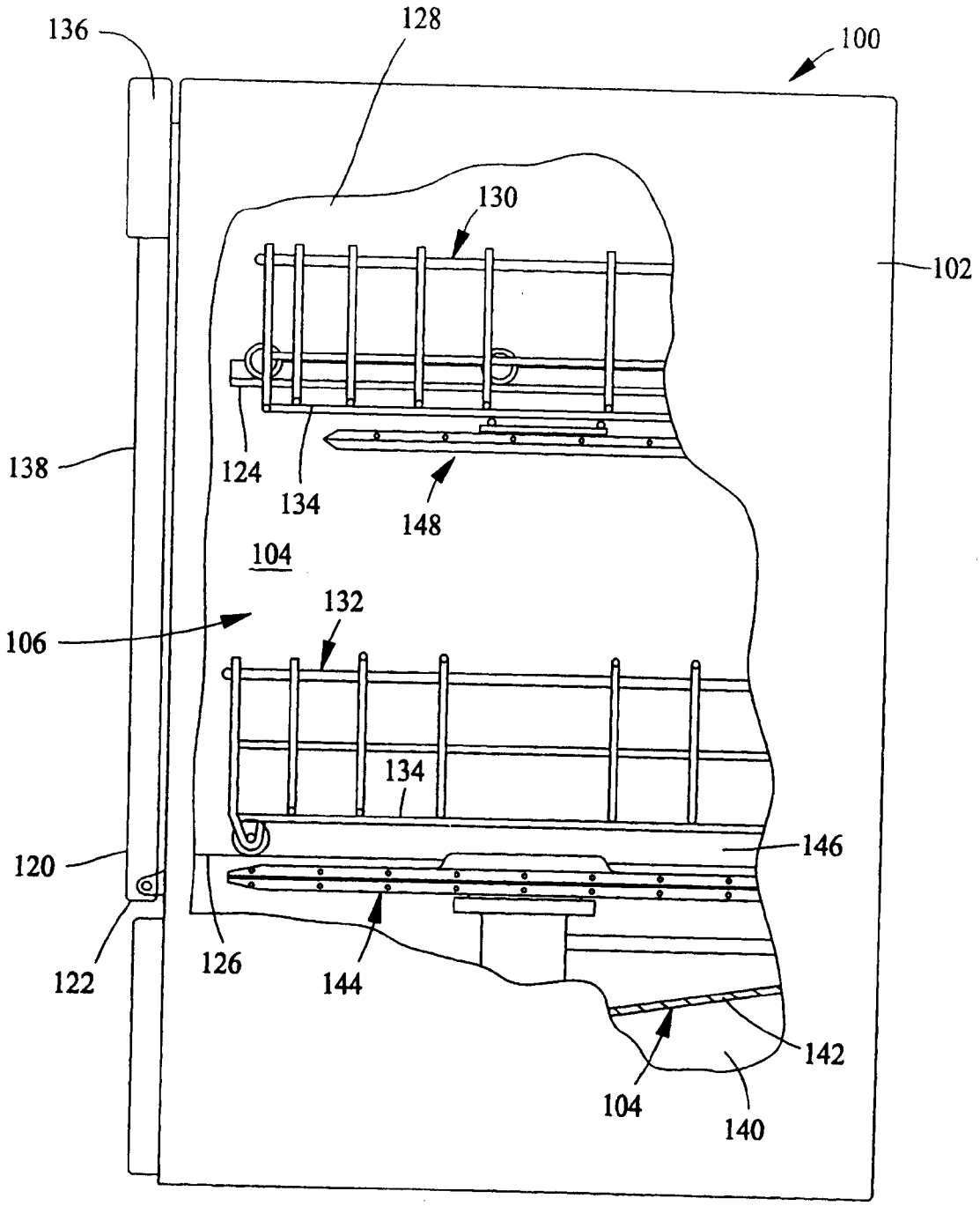
Figure 2:
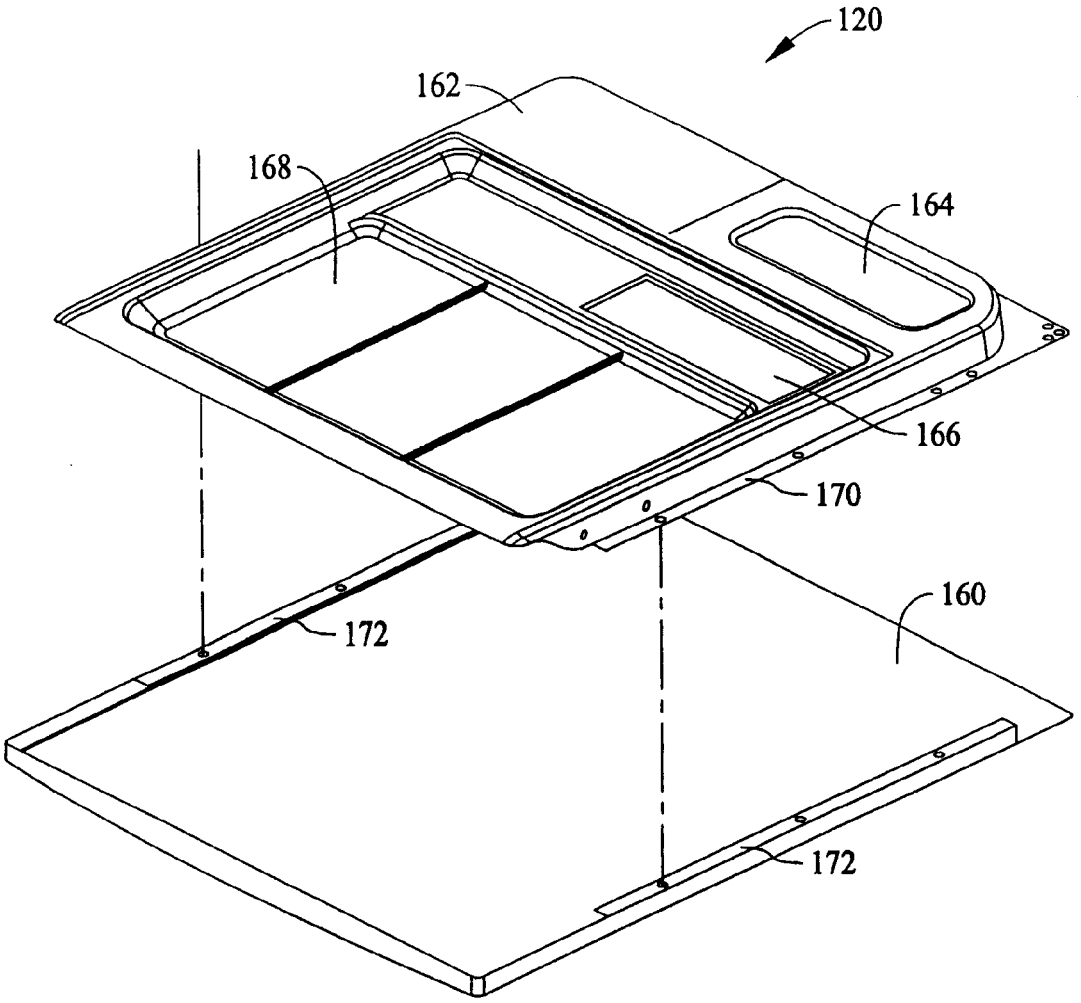
Figure 3:
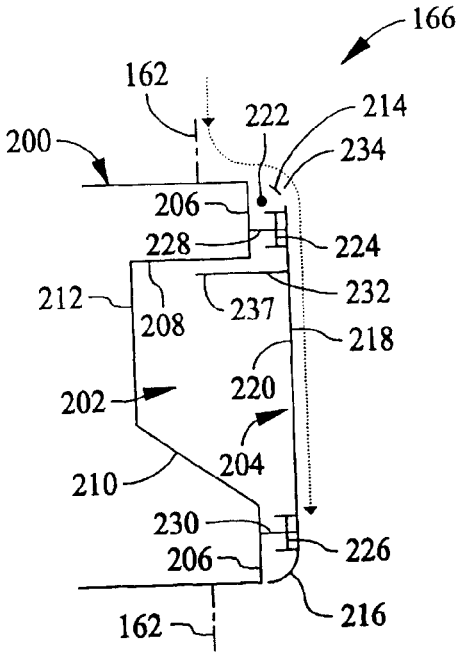
Figure 4:
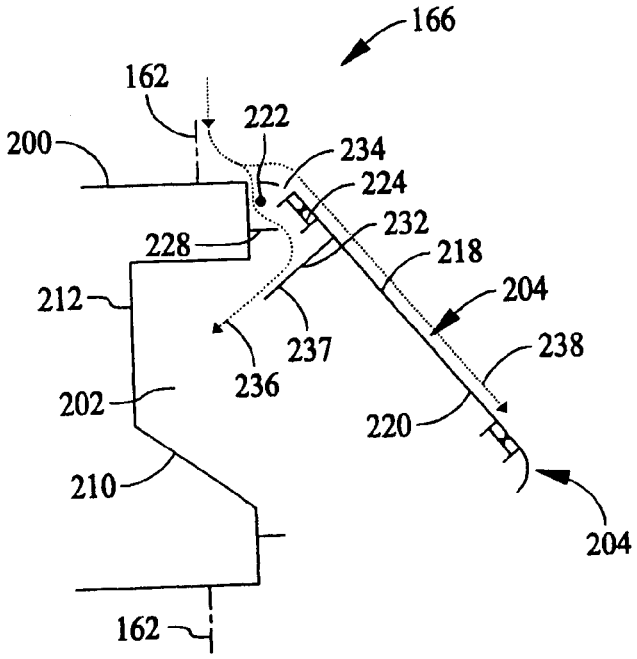

FIGS. 3 and 4 are cross-sectional schematic illustrations of dispenser 166 attached to inner door panel 162 illustrating dispenser 166 in closed and opened positions, respectively. Dispenser 166 includes a body 200 defining a trough 202, and a cover 204 attached to body 200 to close trough 202 until a designated time in a dishwasher wash cycle. Cover 204 is selectively positionable between an open position (shown in FIG. 4) wherein dishwasher detergent may be loaded or released from trough 202 in use, and a closed position (shown in FIG. 3) wherein trough 202 is substantially sealed to protect contents of trough 202 from moisture until a designated release time. Detergent (not shown) in one embodiment is manually loaded into trough 202 in use and cover 204 is securely closed by a user, such as, for example, with a snap-fit engagement or other known locking or latching arrangement. As desired, cover 204 may be opened from the closed position to the open position to release detergent from trough 202 with known mechanisms, including but not limited to cam operated mechanisms (not shown) familiar to those in the art and adapted to open the dispenser at a pre-selected time in a wash cycle.

In an illustrative embodiment, dispenser body 200 is fabricated from a known plastic material according to known techniques and includes a generally flat outer surface 206 surrounding trough 202. In one embodiment trough 202 includes a first side wall 208 extending from and substantially perpendicular to outer surface 206, an inclined or angled side wall 210 extending from outer surface 206 opposite first side wall 208, and a flat rear wall 212 extending between respective ends of side walls 208, 210 and substantially parallel to outer surface 206. Trough 208 is sized and dimensioned to contain an adequate amount of detergent for desired wash cycles, and, when vertically oriented (as illustrated in FIGS. 3 and 4) lower side wall 210 is downwardly sloped toward dispenser outer surface 206, thereby facilitating gravity assisted discharge of detergent from trough 202 when cover 204 is in the open position.

Cover 204, in one embodiment, is also fabricated from a known plastic material according to known techniques and includes opposite rounded ends 214, 216, a generally planar outer surface 218 and an inner surface 220 extending between ends 214, 216. Cover is pivotally attached at one end via a hinge 222 coupled to dispenser body 200 such that cover 204 pivots about hinge 214 between the closed position (shown in FIG. 3) and the open position (shown in FIG. 4) and a baffle 232 extends from inner cover surface 220 toward trough rear wall 212 In one embodiment, baffle 232 extends substantially perpendicular to cover inner surface 220 and trough rear wall 212, although it is appreciated that other relative orientations of baffle 232 and cover inner surface 220 may be employed in alternative embodiments.

Seal members 224, 226 are attached to cover inner surface 220 adjacent each end 214, 216 of cover 204, and seal members 224, 226 engage knife blade projections 228, 230 extending from dispenser outer surface 206 adjacent trough 202. In one embodiment, seal members 224, 226 are resilient rubber gaskets that receive cover outer surface projections 228, 230 therein to form a watertight seal around a perimeter of trough 202. It is recognized, however, that seal members, such as seal members 224, 226 may be attached to dispenser body outer surface 206 and engaged to projections extending from cover inner surface to similarly seal trough 202 and protect detergent therein from moisture when dispenser 166 is closed. It is further contemplated that other known seal members and sealing mechanisms may likewise be employed in alternative embodiments without departing from the scope of the present invention.

When cover 204 is in the closed position as illustrated in FIG. 3, trough 202, cover inner surface 220, and seal members 224, 226 form a watertight enclosure for containing detergent. As illustrated by the arrows in FIG. 3, dishwasher fluid splashed and/or sprayed in the vicinity of dispenser 166 flows down inner door panel 162, over dispenser body 200 and body outer surface 206, and because seal members 224, 226 obstruct the flow path into trough 202, fluid flows over cover outer surface 218 situated over dispenser trough 202. As such, detergent contained in trough 202 is protected from undesirable moisture when cover 204 is closed and premature release of detergent from dispenser 226 is prevented.

Unlike conventional dispensers, dispenser cover 204 includes an opening 234 therethrough, which, in conjunction with cover baffle 232, defines a flow path 236 to direct at least a portion of fluid passing over dispenser body 202 and body outer surface 206 into trough 202 to facilitate complete discharge and more timely release of detergent in trough 202 when cover 204 is in the open position (as illustrated in FIG. 4). Fluid flowing through cover opening 234 flows around seal member 224 and dispenser body projection 228 to baffle 232 that is pointed toward trough 202. In one embodiment, and in the open position, cover baffle 232 is angled or inclined with respect to trough rear wall 212 and sloped trough side wall 210 when cover 204 is in the open position. Fluid is therefore directed into trough 202 though cover 204 in a manner to facilitate removal of detergent from trough 202. As such, a separate jet of fluid to clean out trough 202 is generally unnecessary, and trough 202 may be fully evacuated with much less noise in comparison to a water jet directed toward dispenser trough 202 when dispenser 166 is attached to door inner panel 162.

In the illustrated embodiment, cover opening 234 is located proximate to hinge 222 whereby cover 204 is attached to dispenser body 200, and cover baffle 232 extends a sufficient length from cover inner surface 220 to complete flow path 236 when cover 204 is fully opened. It is appreciated, however, that cover opening 234 could be located elsewhere in alternative embodiments to complete flow path 236 without compromising the watertight aspects of dispenser 166 when closed. Additionally, in one embodiment a distal end 237 of baffle 232 is generally located outside of trough 202 when cover 204 is in the open position so as not to impede gravitational forces on detergent when cover is opened, while in the closed position, baffle distal end 237 is extended into or within trough 202.

In addition, due to baffle 136 directing fluid into dispenser trough 202, trough 202 may be cleared even when cover 204 is not fully opened, unlike conventional detergent dispensers that rely upon fluid jets directed toward the dispenser. It is understood that cover opening 234 may be varied in dimension to adjust relative portions of fluid directed into flow path 236 and a flow path 238 along cover outer surface 218, thereby providing more or less fluid into trough 202 as may be desired.

A more reliable detergent dispenser is therefore provided that may be implemented with reduced noise in comparison to conventional dishwasher systems.

While the invention has been described in terms of various specific embodiments, those skilled in the art will recognize that the invention can be practiced with modification within the spirit and scope of the claims.

What is claimed is:

1. A detergent dispenser for a dishwasher, said dispenser comprising:

a body comprising a trough; and a cover attached to said body and comprising a flow path extending into said trough, said cover comprising an outer surface, said outer surface comprising an opening therethrough for directing fluid to said flow path.

2. A dispenser in accordance with claim 1 wherein said cover is attached to said body at a hinge, said opening located proximate said hinge.

3. A dispenser in accordance with claim 1 wherein said flow path comprises a baffle.

4. A dispenser in accordance with claim 3 wherein said trough comprises a first side wall, said baffle is angled with respect to said first side wall when said cover is in an open position.

5. A dispenser in accordance with claim 3, said baffle extending substantially perpendicular to said outer surface.

6. A dispenser in accordance with claim 1 wherein said cover comprises an inner surface, said inner surface comprising at least one seal.

7. A detergent dispenser comprising:

a body comprising a trough; and a cover pivotally attached to said body at one end, said cover comprising an outer surface comprising an opening therethrough proximate said attached end, and an inner surface comprising a baffle extending therefrom toward said trough, said baffle defining a flow path into said trough through said opening when said cover is in said open position.

8. A detergent dispenser in accordance with claim 7 wherein said baffle comprises a distal end, said distal end located within said trough when said cover is in a closed position.

9. A detergent dispenser in accordance with claim 7, said cover comprising at least one seal.

10. A detergent dispenser in accordance with claim 7, said baffle extending substantially perpendicular to said inner surface.

11. A detergent dispenser for a dishwasher door assembly, said dispenser comprising:

a body comprising a trough; and a cover comprising a first end, a second end, an inner surface extending between said ends, said cover selectively positionable between a closed position and an open position, said cover comprising a flow path through an outer surface thereof and into said trough when said cover is in said open position, said flow path obstructed when said cover is in said closed position.

12. A detergent dispenser in accordance with claim 11, said flow path comprising a flow path opening.

13. A detergent dispenser in accordance with claim 11, at least one of said body and said cover comprising at least one seal, said at least one seal preventing wash fluid from entering said trough when said cover is in said closed position.

14. A detergent dispenser in accordance with claim 11, wherein said flow path comprises a baffle extending toward said trough.

15. A dishwasher comprising:

a wash chamber; and a detergent dispenser in flow communication with said wash chamber, said detergent dispenser comprising:

a body comprising a trough; and a cover hingedly attached to said body and selectively positionable between a sealed closed position and an open position, said cover configured to generate a flow path from an outer surface of said cover into said trough when said cover is in said open position.

16. A dishwasher in accordance with claim 15, said cover further comprising a flow path opening therethrough.

17. A dishwasher in accordance with claim 16, said cover comprising a baffle in fluid communication with said flow path opening when said cover is in said open position.

18. A dishwasher in accordance with claim 17, said cover baffle not in fluid communication with said opening when said cover is in said closed position.

19. A dishwasher in accordance with claim 18, further comprising a door assembly, said detergent dispenser attached to said door assembly.

* * * * *

UNITED STATES PATENT AND TRADEMARK OFFICE

CERTIFICATE OF CORRECTION

PATENT NO. : 6,622,896 B2
DATED : September 23, 2003
INVENTOR(S) : Hegeman et al.

It is certified that error appears in the above-identified patent and that said Letters Patent is hereby corrected as shown below:

Delete Title page illustrating figure, and substitute therefor new Title page illustrating figure (attached).

Delete drawing sheets 1-3, and substitute therefor drawing sheets 1-3, with the attached sheets.

Signed and Sealed this

Twenty-ninth Day of November, 2005

JON W. DUDAS
*Director of the United States Patent and Trademark Office*

(12) United States Patent
Hegeman et al.

(10) Patent No.: US 6,622,896 B2
(45) Date of Patent: Sep. 23, 2003

(54) DISHWASHER DETERGENT DISPENSER

(75) Inventors: Arjan Johannes Hegeman, Louisville, KY (US); Jeffrey Thomas Kiesler, Louisville, KY (US); Gregory Alan Meyer, Taylorsville, KY (US); Gregory Owen Miller, Louisville, KY (US); Christopher Raymond Geisen, Louisville, KY (US); Glenn Leon Graham, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,861

(22) Filed: Oct. 25, 2001

(65) Prior Publication Data

US 2003/0080162 A1 May 1, 2003

(51) Int. Cl.[7] ..... A47L 15/46; D06F 39/02

(52) U.S. Cl. ..... 222/651; 134/57 D; 134/58 D

(58) Field of Search ..... 222/556, 651, 222/652; 134/56 D, 57 D, 58 D, 93

(56) References Cited

U.S. PATENT DOCUMENTS

| | | | | | |
|---|---|---|---|---|---|
| 2,946,489 | A | * | 7/1960 | Brucken | 222/651 |
| 3,402,853 | A | * | 9/1968 | Perl | 222/651 |
| 3,827,600 | A | * | 8/1974 | Janke | 222/70 |
| 4,790,981 | A | | 12/1988 | Mayer et al. | |
| 5,033,659 | A | * | 7/1991 | Marks et al. | 222/651 |
| 5,133,487 | A | * | 7/1992 | Russi | 222/651 |
| 5,310,090 | A | | 5/1994 | Taylor, Jr. | |
| 6,244,277 | B1 | | 6/2001 | Maunsell | |

* cited by examiner

*Primary Examiner*—Joseph A. Kaufman
(74) *Attorney, Agent, or Firm*—George L. Rideout, Jr.; Armstrong Teasdale, LLP

(57) ABSTRACT

A dispenser is provided which includes a body including a trough, and a cover attached to the body and including a flow path extending into the trough.

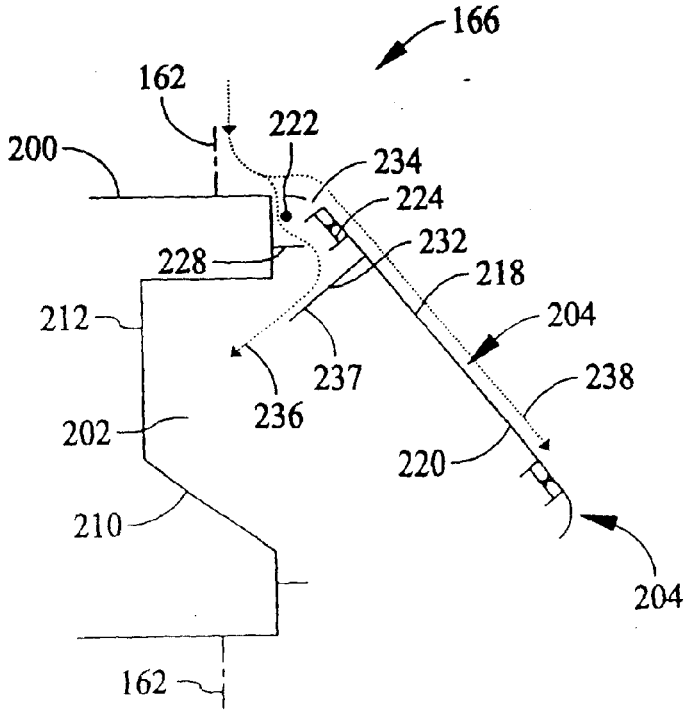

19 Claims, 3 Drawing Sheets